US011087919B2

(12) United States Patent
Lee et al.

(10) Patent No.: US 11,087,919 B2
(45) Date of Patent: Aug. 10, 2021

(54) INDUCTOR ARRAY INCLUDING COIL COMPONENTS

(71) Applicant: SAMSUNG ELECTRO-MECHANICS CO., LTD., Suwon-si (KR)

(72) Inventors: Dong Jin Lee, Suwon-si (KR); Young Ghyu Ahn, Suwon-si (KR); Chan Yoon, Suwon-si (KR); Dong Hwan Lee, Suwon-si (KR); Won Chul Sim, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 444 days.

(21) Appl. No.: 16/175,168

(22) Filed: Oct. 30, 2018

(65) Prior Publication Data

US 2019/0362888 A1 Nov. 28, 2019

(30) Foreign Application Priority Data

May 24, 2018 (KR) ..... 10-2018-0058709

(51) Int. Cl.

| | |
|---|---|
| ***H01F 27/28*** | (2006.01) |
| ***H01F 27/40*** | (2006.01) |
| ***H01F 27/29*** | (2006.01) |
| *H01F 27/32* | (2006.01) |

(52) U.S. Cl.

CPC ..... *H01F 27/40* (2013.01); *H01F 27/28* (2013.01); *H01F 27/292* (2013.01); *H01F 27/327* (2013.01)

(58) Field of Classification Search

CPC ..... H01F 27/40; H01F 27/292; H01F 27/327; H01F 17/04; H01F 2017/048; H01F 27/28; H01F 27/34

See application file for complete search history.

(56) References Cited

U.S. PATENT DOCUMENTS

| | | | |
|---|---|---|---|
| 2008/0290977 A1 | 11/2008 | Ito et al. | |
| 2017/0006706 A1* | 1/2017 | Yoon | H01F 17/04 |

FOREIGN PATENT DOCUMENTS

| | | | |
|---|---|---|---|
| JP | H11-224817 A | | 8/1999 |
| JP | 2003-217935 A | | 7/2003 |
| JP | 2017199766 A | * | 11/2017 |
| KR | 10-2008-0102993 A | | 11/2008 |

* cited by examiner

*Primary Examiner* — Tuyen T Nguyen

(74) *Attorney, Agent, or Firm* — Morgan, Lewis & Bockius LLP

(57) ABSTRACT

A coil component includes a body including first, second, third and fourth coils and including a first end surface and a second end surface opposed in a first direction, a first side surface and a second side surface opposing each other in a second direction, and an upper surface and a lower surface opposing each other in a third direction and a plurality of external electrodes disposed on the body and connected to the first to fourth coils. A first group including the first and second coils is arranged in point symmetry with respect to a second group including the third and fourth coils about a center between the first and second groups.

20 Claims, 6 Drawing Sheets

INDUCTOR ARRAY INCLUDING COIL COMPONENTS

CROSS-REFERENCE TO RELATED APPLICATION(S)

This application claims the benefit of priority to Korean Patent Application No. 10-2018-0058709 filed on May 24, 2018 in the Korean Intellectual Property Office, the disclosure of which is incorporated herein by reference in its entirety.

BACKGROUND

1. Field

The present disclosure relates to a coil component, and more particularly, to an inductor array.

2. Description of Related Art

As miniaturized electronic products such as smartphones and the like are actively developed, a demand for thinned power inductors of a small size having high current, high efficiency, and high performance characteristics is increased.

At the same time, demand for an array having an advantage of being capable of reducing a mounting area is also increased. The array may be a noncoupled or coupled type inductor, or a mixed noncoupled and coupled type inductor, depending on a coupling coefficient or a mutual inductance between a plurality of coil parts.

Meanwhile, in the case of a noncoupled inductor array in which a plurality of coils are disposed to be spaced apart from each other and are not mutually affected by magnetic fluxes, when the inductances of the coils may be equally implemented, efficiency of the inductor array may be increased, together with an effect of reducing the mounting area.

In a noncoupled inductor array, it is important to significantly decrease mutual inductance by decreasing the coupling coefficient between two coils. When the coupling coefficient between the two coils is a certain coupling coefficient or more, a voltage rise phenomenon in a micro current region occurs due to the mutual inductance between the two coils. The coupling coefficient of about 0.05 or less is required to prevent the voltage rise phenomenon. In order to lower the coupling coefficient between the two coils, an interval between the two coils should be increased. However, due to the limitations of an inductor size, it may be difficult to simply increase the interval between the two coils in order to similarly lower the coupling coefficient between all the coils to a certain coupling coefficient or less.

SUMMARY

An aspect of the present disclosure may provide a structure capable of significantly reducing a coupling coefficient between coils adjacent to each other in a coil component of a noncoupled inductor.

According to an aspect of the present disclosure, a coil component may include a body including first to fourth coils and including a first end surface and a second end surface opposed in a first direction, a first side surface and a second side surface opposing each other in a second direction, and an upper surface and a lower surface opposing each other in a third direction and a plurality of external electrodes disposed on the body and connected to the first to fourth coils. The first to third directions are arranged to be perpendicular to each other, the first to fourth coils are disposed to be spaced apart from each other in the first direction, and a first group including the first and second coils is arranged in point symmetry with respect to a second group including the third and fourth coils about a center between the first and second groups.

The first and second coils may be mirror-symmetrical to each other with respect to the first reference line.

A coil center of each of the first to fourth coils may be disposed on the second reference line.

Each of the first to fourth coils may include upper and lower coils connected to each other.

The upper coil of the first coil and the upper coil of the second coil may be exposed to the first side surface of the body, and the lower coil of the first coil and the lower coil of the second coil may be exposed to the second side surface of the body.

The upper coil of the third coil and the upper coil of the fourth coil may be exposed to the second side surface of the body, and the lower coil of the third coil and the lower coil of the fourth coil may be exposed to the first side surface of the body.

The upper and lower coils of each of the first to fourth coils may be symmetrical to each other with respect to a virtual center line which is the center of the upper surface and the lower surface of the body.

The first and second coils may be defined as a first group, the third and fourth coils may be defined as a second group, and the first group and the second group may be arranged to be point-symmetrical to each other with respect to the center between the first and second groups.

The second and third coils may be spaced apart from each other toward the first side surface and the second side surface of the body, respectively, with respect to the second reference line.

A leading part of the upper coil of the second coil may be shorter than a leading part of the lower coil of the second coil, and a leading part of the upper coil of the third coil may be shorter than a leading part of the lower coil of the third coil.

A leading part of the upper coil of the first coil may be identical to a leading part of the lower coil of the first coil, and a leading part of the upper coil of the fourth coil may be identical to a leading part of the lower coil of the fourth coil.

The first and fourth coils may be spaced apart from each other toward the second side surface and the first side surface of the body, respectively, with respect to the second reference line.

A leading part of the upper coil of the first coil may be longer than a leading part of the lower coil of the first coil, and a leading part of the upper coil of the fourth coil may be longer than a leading part of the lower coil of the fourth coil.

The body may further include an encapsulant encapsulating the first to fourth coils.

Each of the first to fourth coils may include a support member supporting the coils.

The first to fourth coils may have the same shape as each other.

The first group and the second group may have 180° rotational symmetry relative to the center between the first and second groups.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Hereinafter, exemplary embodiments of the present disclosure will now be described in detail with reference to the accompanying drawings.

Figure 1:
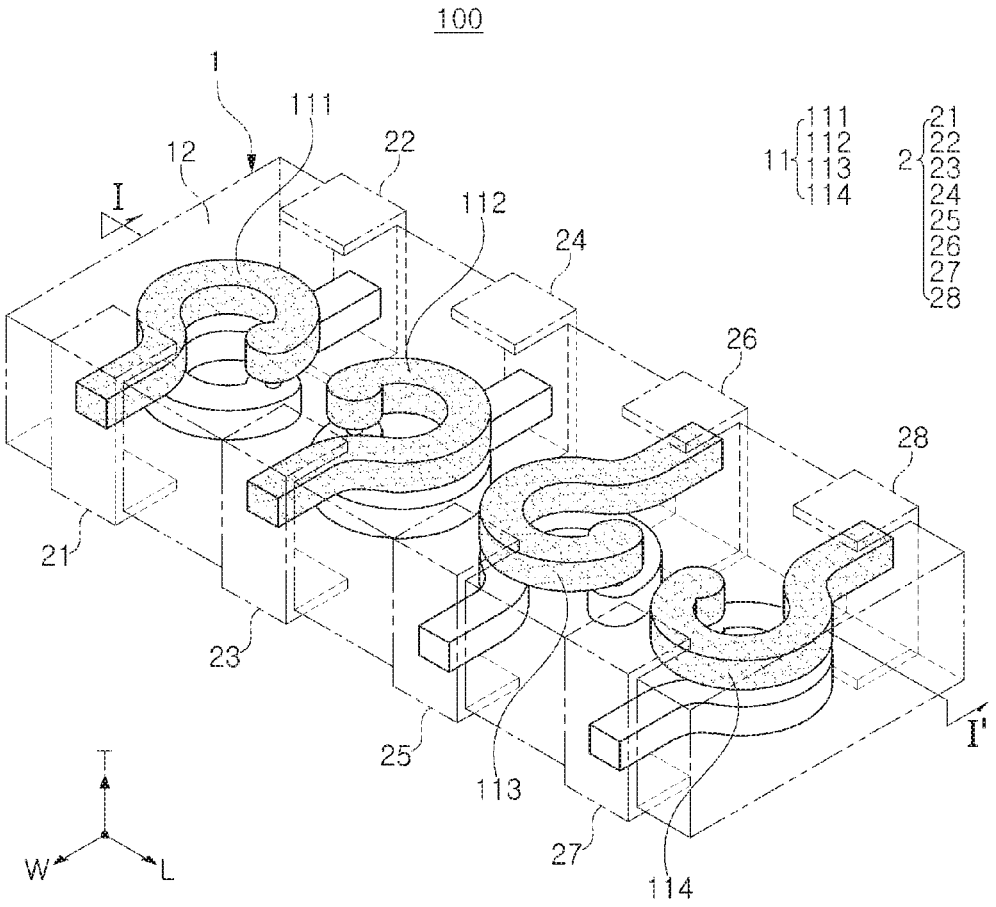
FIG. 1 is a schematic perspective view illustrating a coil component according to an exemplary embodiment in the present disclosure.
Figure 2:
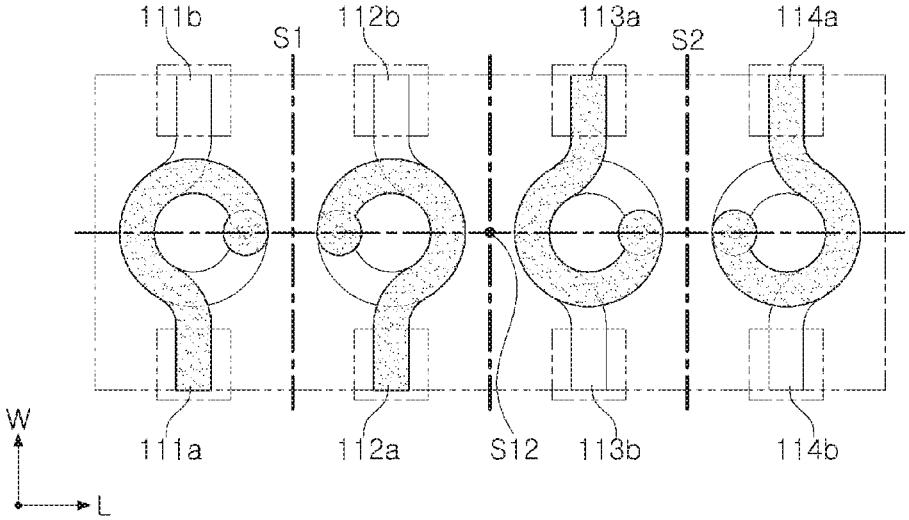
FIG. 2 is a plan view when being viewed from a top surface of FIG. 1.
Figure 3:
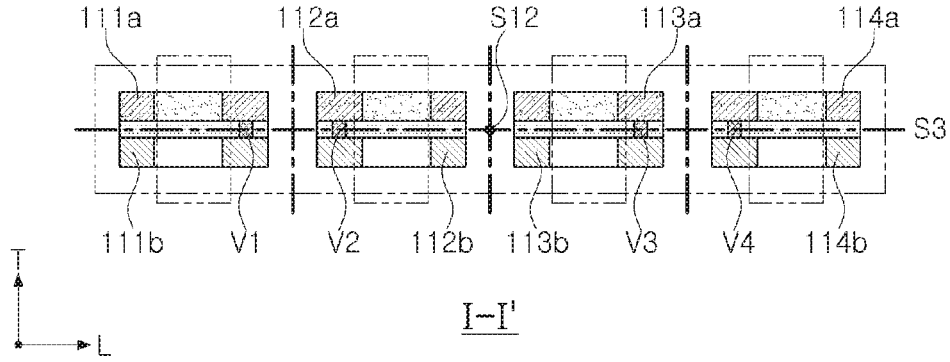
FIG. 3 is a cross-sectional view taken along a line I-I' of FIG. 1.

FIG. 1 is a schematic perspective view illustrating a coil component according to an exemplary embodiment in the present disclosure, FIG. 2 is a plan view when being viewed from a top surface of FIG. 1, and FIG. 3 is a cross-sectional view taken along a line I-I' of FIG. 1.

Referring to FIGS. 1 through 3, a coil component 100 may correspond to an inductor array including a plurality of coils which are spaced apart from each other therein. The coil component illustrated in FIGS. 1 through 3 includes a total of four coils, but is not limited thereto, and those skilled in the art may provide a coil component including more than four coils.

The coil component 100 may include a body 1 and an external electrode 2 disposed on an external surface of the body.

The body 1 may determine an outer shape of the coil component, and include a first end surface and a second end surface opposing each other in a length (L) direction, which is a first direction, a first side surface and a second side surface opposing each other in a width (W) direction, which is a second direction, and an upper surface and a lower surface opposing each other in a thickness (T) direction, which is a third direction, to have a substantially hexahedral shape. A distance between the first and second end surfaces may be greater than a distance between the first and second side surfaces, which facilitates forming a structure in which the plurality of coils are spaced apart from each other in the length direction.

The body 1 may include a plurality of coils 111, 112, 113, and 114 which are spaced apart from each other in the length direction therein. The plurality of coils may substantially have the same shape. Here, the disclosure that the plurality of coils have the same shape means that the line width, thickness, and number of windings of the coil pattern of each coil are substantially the same. In FIGS. 1 through 4, the number of windings of the coil is represented by 1 turn for convenience of explanation, but is not limited thereto, and may be appropriately selected in consideration of electrical characteristics such as inductance or Rdc required by those skilled in the art.

An array structure of the plurality of coils 111, 112, 113, and 114 will be described in more detail with reference to FIG. 2. A first coil 111 of the plurality of coils closest to the first surface of the body and a second coil 112 adjacent to the first coil 111 may be symmetrical to each other with respect to a first reference line S1 parallel to the width direction of the body. The second coil may be mirror-symmetrical with the first coil with respect to the first reference line. Here, the first reference line may be a virtual line which is in parallel to the width direction of the body and is spaced apart from each of the first and second coils by the same distance.

Next, third and fourth coils 113 and 114 may be disposed at positions spaced apart from the first coil and the second coil in the length direction of the body. In this case, the third and fourth coils may be spaced apart from the first and second coils in the length direction of the body, and may be symmetrical with each other with respect to a second reference line S2 parallel to the width direction of the body. Here, the second reference line may be a virtual line which is in parallel to the width direction of the body and is spaced apart from each of the third and fourth coils by the same distance. When the first and second coils are referred to as a first group and the third and fourth coils are referred to as a second group, the first group and the second group may be arranged in point symmetry about the center S12 between the first and second groups. In this case, a position of the center S12 in the thickness direction of the body may be disposed on a center line S3 to be described below. The first group and the second group have 180° rotational symmetry relative to the center between the first and second groups.

Due to the array structure, upper coils of the first group may be exposed to the first side surface of the body, while upper coils of the second group may be exposed to the second side surface of the body opposing the first side surface of the body. Similarly, lower coils of the first group may be connected to the upper coils of the first group through vias and may be exposed to the second side surface, while lower coils of the second group may be connected to the upper coils of the second group and may be exposed to the first side surface of the body.

Meanwhile, the first coils 111 may be connected to the first and second external electrodes 21 and 22 disposed to be spaced apart from each other in the width direction of the body, and the second coil 112 may be connected to the third and fourth external electrodes 23 and 24 disposed to be spaced apart from each other in the width direction of the body. Similarly, the third coil and the fourth coil 113 and 114 may be connected to fifth and sixth external electrodes 25 and 26, and seventh and eighth external electrodes 27 and 28, respectively, which are spaced apart from each other in the width direction of the body.

The first to eighth external electrodes may extend from the first side surface or the second side surface of the body to the upper and lower surfaces of the body, and be formed in a "⊏" letter shape, but are not limited thereto, and may be modified into an L-shaped electrode or an I-shaped electrode.

Referring to FIG. 3, the first coil 111 may include an upper coil 111*a* and a lower coil 111*b*, and the upper and lower coils may be electrically connected to each other through a via v1. The upper and lower coils may be formed on upper and lower surfaces of a support member 13, respectively, and the via may be formed by filling a via hole penetrating through the support member.

The upper coil may be arranged symmetrically with the lower coil with respect to a virtual center line S3 that is half a thickness of the body. The same contents may also be applied to the second to fourth coils 112, 113, and 114, and overlapped descriptions will be omitted.

In addition, the first to fourth coils 111, 112, 113, and 114 may be encapsulated by an encapsulant 12, and the encapsulant 12 may be included as long as it is a material including magnetic characteristics. The encapsulant 12 may have a structure in which magnetic particles are dispersed in a resin, and the magnetic particle may be a metal based soft magnetic powder and be formed of a crystalline or amorphous metal containing one or more selected from the group consisting of iron (Fe), silicon (Si), boron (B), chromium (Cr), aluminum (Al), copper (Cu), niobium (Nb), and nickel (Ni). In addition, the resin may be a thermoplastic resin or a thermosetting resin. Examples of the thermosetting resin may include benzocyclobutene (BCB), an epoxy resin, a phenol resin, a vinyl ester resin, a polyimide (PI) resin, a polyvinyl benzyl ether resin, and the like. In addition, examples of the thermoplastic resin may include a polyethylene (PE) resin, a polypropylene (PP) resin, a polybutene resin, a polyvinyl alcohol resin, and the like.

The encapsulant may substantially determine the outer shape of the body. Although not specifically illustrated, an insulating sheet or the like may be applied on the encapsulant so as to protect the body from permeation of a plating solution generated from the external electrodes or permeation of a solder of soldering required at the time of mounting the coil component.

A coupling coefficient between the coils in the inductor array including the four coils spaced apart from each other may be significantly reduced through the structure of the coil component 100 of FIGS. 1 through 3 described above.

Figure 4:
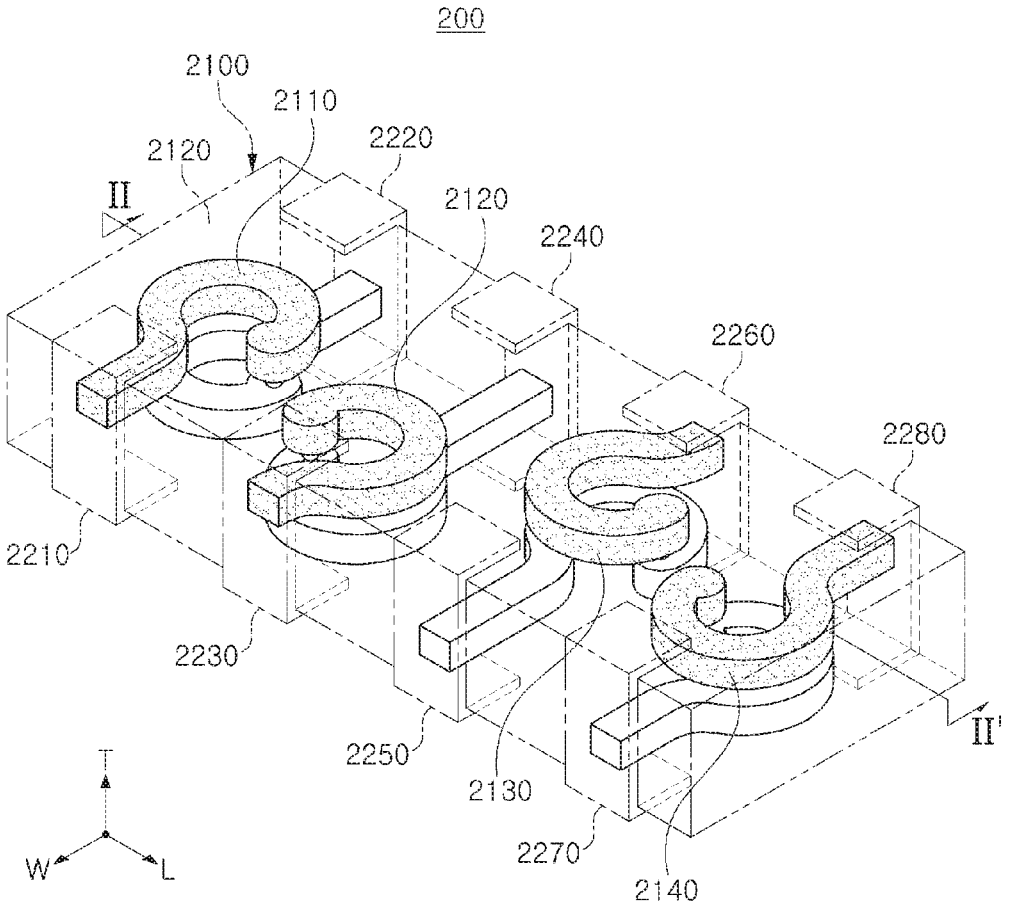
FIG. 4 is a schematic perspective view illustrating a coil component according to a modified example of the coil component of FIG. 1.
Figure 5:
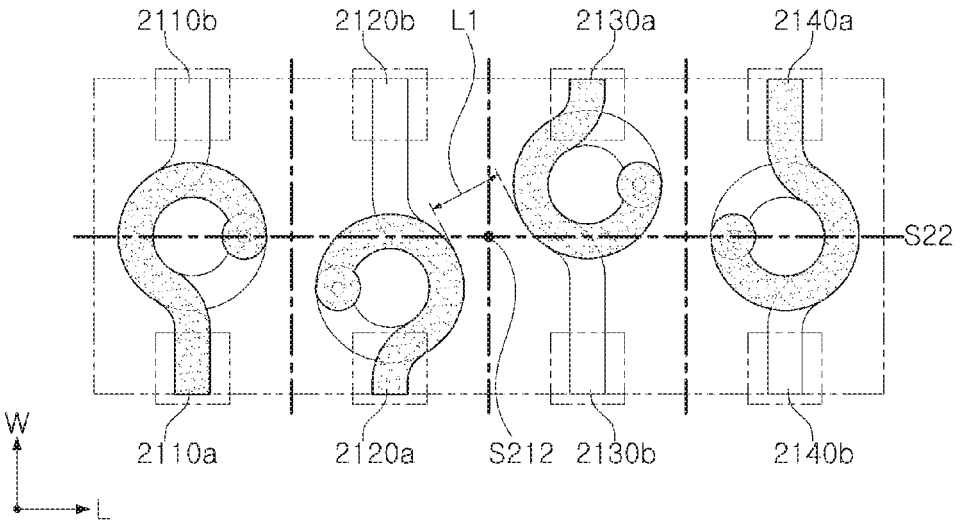
FIG. 5 is a plan view when being viewed from a top surface of FIG. 4.

FIG. 4 is a schematic perspective view illustrating a coil component 200 according to a modified example of the coil component 100. FIG. 5 is a plan view when being viewed from a top surface of FIG. 4 and FIG. 6 is a cross-sectional view taken along a line II-II' of FIG. 4.

Figure 6:
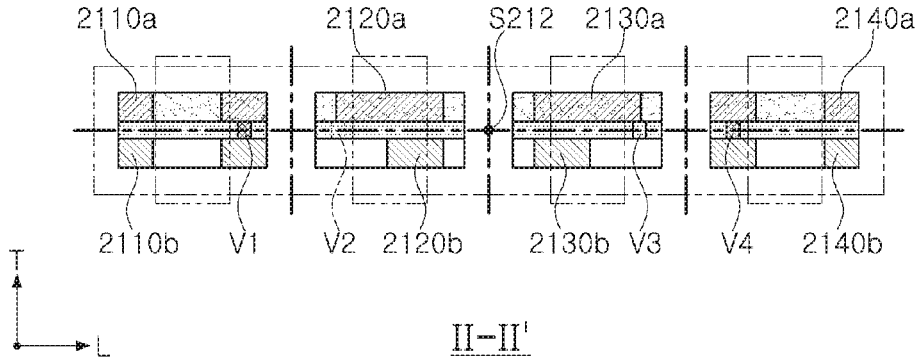
FIG. 6 is a cross-sectional view taken along a line II-II' of FIG. 4.

Since the coil component 200 disclosed in FIGS. 4 through 6 is substantially identical to the coil component 100 described with reference to FIGS. 1 through 3 except for the arrangement positions of the second and third coils, overlapped descriptions will be omitted.

Referring to FIGS. 4 through 6, the coil component 200 may include first to fourth coils 2110, 2120, 2130, and 2140. The first to fourth coils may be arranged to be spaced apart from each other in the length direction of the body. The first to fourth coils may be connected to first and second external electrodes 2210 and 2220, third and fourth external electrodes 2230 and 2240, fifth and sixth external electrodes 2250 and 2260, and seventh and eighth external electrodes 2270 and 2280, respectively.

The second and third coils 2120 and 2130 of the first to fourth coils may be positioned to be shifted from each other by a predetermined distance with respect to a second reference line S22. The second coil 2120 may be positioned to be adjacent to the first side surface of the body from the second reference line, and the third coil 2130 may be positioned to be adjacent to the second side surface of the body from the second reference line. Specifically, a leading part of an upper coil of the second coil may be shorter than a leading part of a lower coil thereof, and a leading part of an upper coil of the third coil may also be shorter than a leading part of a lower coil thereof. This is distinguished from the coil component 100 in which the centers of the second and third coil are disposed on the second virtual line and lengths of upper and lower leading parts are substantially equal to each other.

As a result, a spaced distance L1 between the second and third coils within the same size of the coil component is greater than that in the coil component 100 described above, such that the coupling coefficient between the coils may be significantly reduced.

At this time, the spaced distance L1 between the second and third coils may be appropriately selected by those skilled in the art, if necessary.

Figure 7:
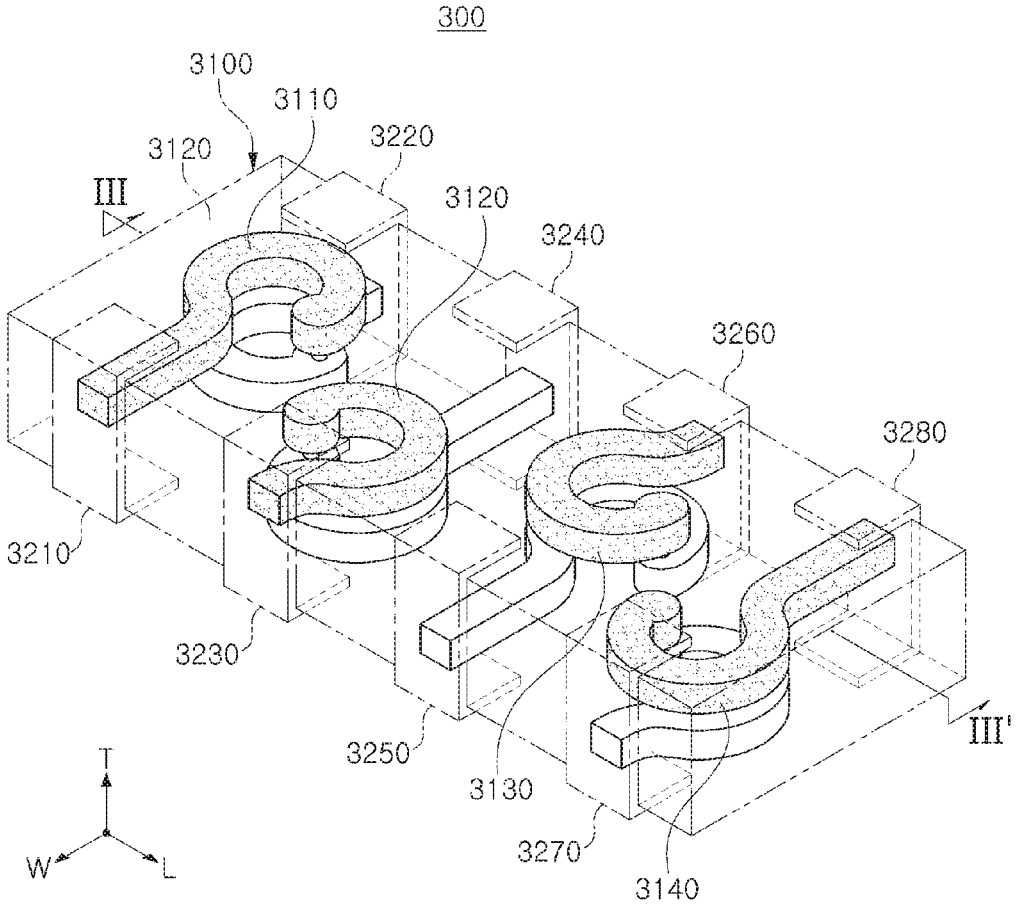
FIG. 7 is a schematic perspective view illustrating a coil component according to another modified example of the coil component of FIG. 1.
Figure 8:
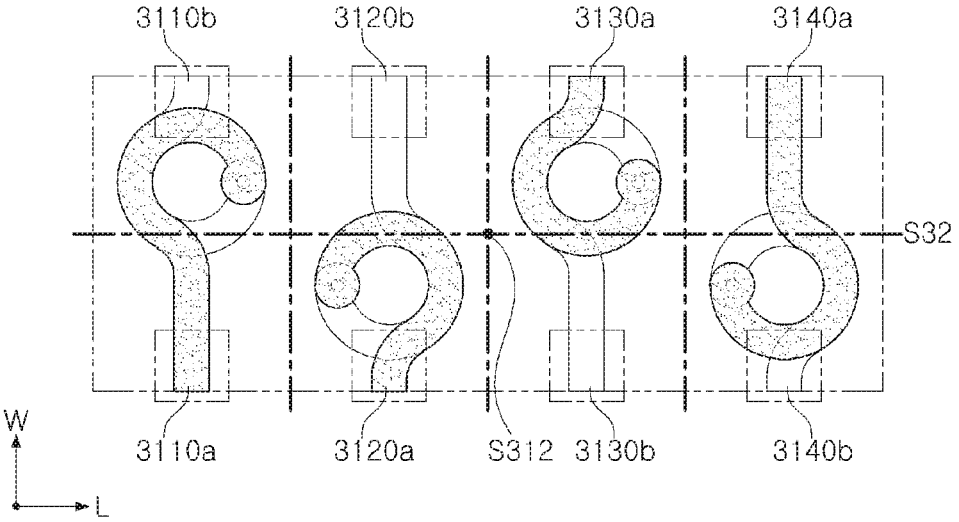
FIG. 8 is a plan view when being viewed from a top surface of FIG. 7.
Figure 9:
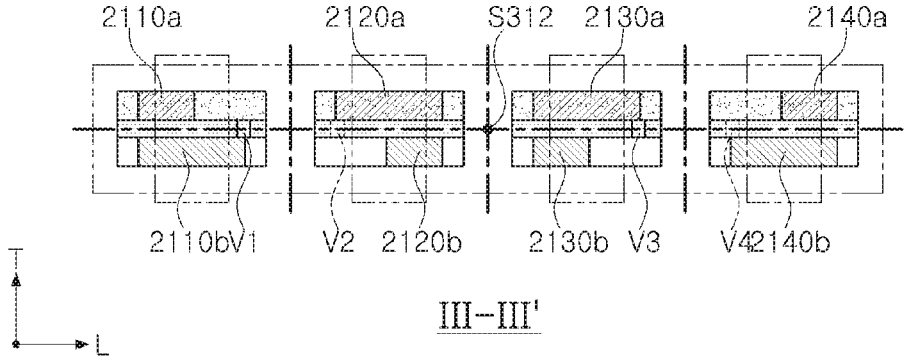
FIG. 9 is a cross-sectional view taken along a line III-III' of FIG. 7.

FIG. 7 is a schematic perspective view illustrating a coil component 300 according to another modified example of the coil component 100 described above, FIG. 8 is a plan view when being viewed from a top surface of FIG. 7, and FIG. 9 is a cross-sectional view taken along a line III-III' of FIG. 7.

Since the coil component 300 is substantially identical to the coil component 200 described with reference to FIGS. 4 through 6 except for the arrangement positions of the first and fourth coils, overlapped descriptions will be omitted.

Referring to FIG. 8, second and third coils 3120 and 3130 may be disposed to be spaced apart from each other by a predetermined distance toward the first side surface and the second side surface of the body, respectively, with respect to a second virtual line S32 parallel to the length direction of the body, and first and fourth coils 3110 and 3140 may be disposed to be spaced apart from each other by a predetermined distance toward the second side surface and the first side surface of the body, respectively, with respect to the second virtual line.

Unlike that the first and fourth coils are disposed to be substantially in parallel to each other along the second virtual line in the coil component 200 of FIGS. 4 through 6, in the coil component 300, the second and third coils 3120 and 3130 may be disposed to be shifted from each other along the width direction of the body from the second virtual line, and the first and fourth coils 3110 and 3140 may also be disposed to be shifted from each other along the width direction of the body from the second virtual line. The first and second coils may be disposed so that distances spaced apart from the second and third coils adjacent to the first and fourth coils, respectively, are increased.

As a result, the coupling coefficient between the coils adjacent to each other may be significantly reduced.

As set forth above, according to an exemplary embodiment in the present disclosure, the coil component including the plurality of coils may have a low coupling coefficient within a limited space.

While exemplary embodiments have been shown and described above, it will be apparent to those skilled in the art that modifications and variations could be made without departing from the scope of the present invention as defined by the appended claims.

What is claimed is:

1. A coil component comprising:

a body including first, second, third and fourth coils and including a first surface and a second surface opposed in a first direction, a third surface and a fourth surface opposing each other in a second direction, and a fifth surface and a sixth surface opposing each other in a third direction; and a plurality of external electrodes disposed on the body and connected to the first, second, third and fourth coils, wherein the first, second and third directions are arranged to be perpendicular to each other, the first, second, third and fourth coils are disposed to be spaced apart from each other in the first direction such that the first, second, third and fourth coils are electrically insulated from each other within the body, and a first group including the first and second coils is arranged in point symmetry with respect to a second group including the third and fourth coils rotationally about a center line extending in the second or third direction between the first and second groups.

2. The coil component of claim 1, wherein the first and second coils are mirror-symmetrical to each other with respect to a virtual reference line disposed between the first and second coils and parallel to the second direction.

3. The coil component of claim 1, wherein a coil center of each of the first, second, third and fourth coils is disposed on a virtual reference line parallel to the first direction and disposed on the centers of the first and second surfaces.

4. The coil component of claim 1, wherein each of the first, second, third and fourth coils includes upper and lower coils connected to each other.

5. The coil component of claim 4, wherein the upper coil of the first coil and the upper coil of the second coil are exposed to the third surface of the body, and the lower coil of the first coil and the lower coil of the second coil are exposed to the fourth surface of the body.

6. The coil component of claim 4, wherein the upper coil of the third coil and the upper coil of the fourth coil are exposed to the fourth surface of the body, and the lower coil of the third coil and the lower coil of the fourth coil are exposed to the third surface of the body.

7. The coil component of claim 4, wherein the upper and lower coils of each of the first, second, third and fourth coils are symmetrical to each other with respect to a virtual center line disposed at a midpoint between the fifth surface and the sixth surface of the body.

8. The coil component of claim 1, wherein the third and fourth coils are mirror-symmetrical to each other with respect to a virtual reference line disposed between the third and fourth coils and parallel to the second direction.

9. The coil component of claim 1, wherein the second and third coils are spaced apart from each other toward the third surface and the fourth surface of the body, respectively, with respect to a virtual reference line parallel to the first direction and disposed on the centers of the first and second surfaces.

10. The coil component of claim 9, wherein a leading part of an upper coil of the second coil is shorter than a leading part of a lower coil of the second coil, and a leading part of an upper coil of the third coil is shorter than a leading part of a lower coil of the third coil.

11. The coil component of claim 9, wherein a leading part of an upper coil of the first coil is identical to a leading part of a lower coil of the first coil, and a leading part of an upper coil of the fourth coil is identical to a leading part of a lower coil of the fourth coil.

12. The coil component of claim 9, wherein the first and fourth coils are spaced apart from each other toward the second side surface and the first side surface of the body, respectively, with respect to the second reference line.

13. The coil component of claim 12, wherein a leading part of an upper coil of the first coil is longer than a leading part of a lower coil of the first coil, and a leading part of an upper coil of the fourth coil is longer than a leading part of a lower coil of the fourth coil.

14. The coil component of claim 1, wherein the body further includes an encapsulant encapsulating the first, second, third and fourth coils.

15. The coil component of claim 1, wherein each of the first, second, third and fourth coils includes a support member supporting the coils.

16. The coil component of claim 1, wherein the first, second, third and fourth coils have the same shape as each other.

17. The coil component of claim 1, wherein the first group and the second group have 180° rotational symmetry relative to the center line between the first and second groups.

18. A coil component comprising:

a body including first, second, third and fourth coils and including a first surface and a second surface opposed in a first direction, a third surface and a fourth surface opposing each other in a second direction, and a fifth surface and a sixth surface opposing each other in a third direction; and a plurality of external electrodes disposed on the body and connected to the first, second, third and fourth coils, wherein the first, second and third directions are arranged to be perpendicular to each other, the first, second, third and fourth coils are disposed to be spaced apart from each other in the first direction, a first group including the first and second coils is arranged in point symmetry with respect to a second group including the third and fourth coils about a center between the first and second groups, each of the first, second, third and fourth coils includes upper and lower coils connected to each other, the upper coil of the first coil and the upper coil of the second coil are exposed to the third surface of the body, and the lower coil of the first coil and the lower coil of the second coil are exposed to the fourth surface of the body.

19. A coil component comprising:

a body including first, second, third and fourth coils and including a first surface and a second surface opposed in a first direction, a third surface and a fourth surface opposing each other in a second direction, and a fifth surface and a sixth surface opposing each other in a third direction; and a plurality of external electrodes disposed on the body and connected to the first, second, third and fourth coils, wherein the first, second and third directions are arranged to be perpendicular to each other, the first, second, third and fourth coils are disposed to be spaced apart from each other in the first direction, a first group including the first and second coils is arranged in point symmetry with respect to a second group including the third and fourth coils about a center between the first and second groups, each of the first, second, third and fourth coils includes upper and lower coils connected to each other, the upper coil of the third coil and the upper coil of the fourth coil are exposed to the fourth surface of the body, and the lower coil of the third coil and the lower coil of the fourth coil are exposed to the third surface of the body.

20. A coil component comprising:

a body including first, second, third and fourth coils and including a first surface and a second surface opposed in a first direction, a third surface and a fourth surface opposing each other in a second direction, and a fifth surface and a sixth surface opposing each other in a third direction; and a plurality of external electrodes disposed on the body and connected to the first, second, third and fourth coils, wherein the first, second and third directions are arranged to be perpendicular to each other, the first, second, third and fourth coils are disposed to be spaced apart from each other in the first direction, a first group including the first and second coils is arranged in point symmetry with respect to a second group including the third and fourth coils about a center between the first and second groups, each of the first, second, third and fourth coils includes upper and lower coils connected to each other, and the upper and lower coils of each of the first, second, third and fourth coils are symmetrical to each other with respect to a virtual center line disposed at a midpoint between the fifth surface and the sixth surface of the body.

* * * * *